United States Patent [19]

Mader

[11] 4,424,727

[45] Jan. 10, 1984

[54] METHOD FOR MAKING A DIE FOR STAMPING METAL REFLECTORS

[75] Inventor: John J. Mader, Tewksbury, Mass.

[73] Assignee: Polaroid Corporation, Cambridge, Mass.

[21] Appl. No.: 187,311

[22] Filed: Sep. 15, 1980

[51] Int. Cl.[3] ..... B21K 5/20; B21D 37/10

[52] U.S. Cl. ..... 76/107 R; 72/702

[58] Field of Search ..... 76/107 R, 101 R, 4; 72/702

[56] References Cited

U.S. PATENT DOCUMENTS

| | | |
|---|---|---|
| 1,306,511 | 6/1919 | Ames, Jr. . |
| 1,401,870 | 12/1921 | Brogan . |
| 1,471,767 | 10/1923 | Wood . |
| 1,471,804 | 10/1923 | Pascucci . |
| 1,501,246 | 7/1924 | Soderberg . |
| 1,793,660 | 2/1931 | Wood . |
| 2,691,905 | 10/1954 | Onksen . |
| 3,262,299 | 7/1966 | Hart et al. . |
| 3,597,602 | 8/1971 | Divoky et al. . |
| 3,609,332 | 9/1971 | Schindler . |
| 3,722,257 | 3/1973 | Bogart et al. . |
| 4,116,038 | 9/1978 | Berthou . |

OTHER PUBLICATIONS

"Seven Ways to Control Springback", Machinery, vol. 73, No. 11, Jul. 1967, pp. 78 and 79.

"The Forming of Sheet Metal", Hecker et al., Scientific American, Nov. 1976, pp. 100–108.

*Primary Examiner*—Roscoe V. Parker

*Attorney, Agent, or Firm*—Francis J. Caufield

[57] ABSTRACT

A method for making a metal stamping die suitable for use in forming sheet metal reflectors for photographic use. The structure of the metal stamping die is made in the manner of the method to compensate for spring-back characteristics of a material used to form a reflector by first constructing a test die which has a predetermined shape related to the desired reflector shape. A comparison is then made between a test workpiece made with the test die and the desired reflector shape to determine the die shape that produces a corresponding portion of the reflector shape. Finally, another die is constructed by shaping it in accordance with the comparison to obtain a final die shape that will acceptably produce the desired reflector shape.

6 Claims, 9 Drawing Figures

METHOD FOR MAKING A DIE FOR STAMPING METAL REFLECTORS

BACKGROUND OF THE INVENTION

1. Field of the Invention

This invention in general relates to methods for making metal stamping dies suitable for use in forming reflectors for use in photographic lighting apparatus and in particular to a method for making such dies for forming reflectors of the type having cross-sectional shapes in the form of polynomial curves.

2. Description of the Prior Art

The utilization of reflectors to intercept radiation emanating from a source and redirect that radiation in a controllable manner to make more efficient use of the available source radiation and achieve a preferred distribution in the intensity of illumination falling on a subject is a well-established practice in the photographic and optical arts.

In lighting apparatus utilizing reflectors, the reflector shape plays an important role, particularly when combined with small sources, in determining the overall area illuminated by the apparatus and the manner in which the illumination varies from one point to another over that area. For photographic lighting apparatus, it is desirable that point-to-point variation in illumination occur in a gradual or smooth manner over the area illuminated because any abrupt change in the intensity of the illumination from one point or area of a subject to another point or area is visually detectable in a photograph as a correspondingly abrupt change in picture density which is not related to actual changes in subject reflectivity as it should be.

Such abrupt changes in illumination could be seen in a picture as alternating light and dark bands across the picture area and are caused by reflector artifact related to the imaging properties of reflectors, how those properties operate to direct illumination over the area illuminated, and how the imaging properties, either by design or fabrication, change from one part of the reflector to another.

In general, the illumination of a point located, say in a plane normal to a lighting apparatus, due to the reflected component of the light from an apparatus depends on the reflectivity of the reflector surface, the size and location of the reflected image of the source, and the solid angle subtended by the image of the source as seen from the point. The size and location of the reflected image from the source, which in turn determine the solid angle subtended by the image of the source as seen from a point, depend on the local curvature of the reflector and how that curvature changes. If the shape of a reflector is such that the local curvature, and hence optical power, abruptly changes, there is a correspondingly abrupt change in the illumination between points or areas of the normal plane which derive their illumination from those portions of the reflector surface where the abrupt change in optical power occurs. Consequently, any reflector shape whose optical power or local radius of curvature does not change in a gradual manner will, depending on the degree of change, cause more or less abrupt changes in illumination from one point to another which are undesirable for photographic purposes.

In U S. Pat. No. 4,356,538 filed in the name of William T. Plummer on Aug. 4, 1980 and entitled "Photographic Lighting Apparatus" and in U.S. Pat. No. 4,355,350 filed in the name of John J. Mader on (mailed Aug. 28, 1980) and entitled "A Reflector For Use In An Artificial Lighting Device", there are described concave reflectors which do not cause abrupt changes in illumination and are therefore highly desirable for photographic lighting work. The reason why the above-noted reflectors do not cause abrupt changes in illumination is a consequence of their reflector shapes which are in the form of higher order polynomials whose first and second derivatives, which determine their radius of curvature and hence optical power, are mathematically continuous. Since the local optical power of these reflectors changes in a gradual manner, the point-to-point variation in illumination provided by these reflectors, when used in combination with a light source, also changes in a gradual manner.

The lighting performance of such polynomial reflectors obviously depends on how well the polynomial shape can be produced with a particular manufacturing process. Polynomial shapes of this sort are capable of being reproduced rather exactly with optical injection molding techniques for fabricating plastic lenses. A mold can be easily shaped by using electric discharge machining techniques to cut the mold and thereafter the mold can be polished to optical tolerances to fabricate a die which will rather precisely reproduce the polynomial shape. Afterwards, a plastic injection molded reflector part is easily provided with a reflector surface through conventional vacuum deposit techniques. However, because of the desirability for fabricating these reflectors from sheet metal and because of the economic benefit from metal stamping, it is a primary object of the present invention to provide a method by which metal stamping dies can be fabricated for forming such reflectors.

Another object of the present invention is to provide a method by which metal stamping dies can be fabricated to produce reflectors having a sufficient approximation of a polynomial shaped reflector so that reflectors formed thereby perform in apparently the same manner as would the precise polynomial shape of the reflector.

Other objects of the invention will, in part, be obvious and will, in part, appear hereinafter. The invention accordingly comprises the method possessing the sequence of steps which are exemplified in the following detailed disclosure.

SUMMARY OF THE INVENTION

This invention in general relates to methods for making metal stamping dies suitable for use in forming reflectors for use in photographic lighting apparatus and in particular to a method for making such dies for forming reflectors of the type having cross-sectional shapes in the form of polynomial curves.

The invention, itself, is a method for making a metal stamping tool suitable for use in forming a concave, open-ended reflector having a cross-sectional shape in the form of a predetermined curve of increasing radius of curvature.

The method of the invention comprises first the step of constructing a trial metal stamping tool having a cross-sectional configuration in the form of a curve of greater concavity than that of the reflector predetermined curve. The trial tool curve is provided with the same general shape as that of the reflector predetermined curve and has a radius of curvature which is generally smaller than the radius of curvature of correpsonding portions of the reflector curve.

Afterwards, a trial reflector is made by stamping with the trial tool a metal blank workpiece of predetermined thickness and material composition.

The cross-sectional shape of the trial reflector is then measured and the measured radius of curvature of the trial reflector is compared with the radius of curvature of the trial tool to determine a calibration function which relates the tool shape required to produce a corresponding reflector shape.

Finally, another metal stamping tool is constructed having a cross-sectional configuration which is shaped in accordance with the calibration function to obtain a final die shape that will acceptably produce the desired predetermined reflector shape.

When it is desired to fabricate a reflector of the type having a cross-sectional shape in the form of a polynomial curve of at least order three and a radius of curvature which increases with increasing distance along the curve as measured from the apex thereof, the following steps are preferred.

Prior to the step of constructing the trial metal stamping tool, the step of dividing the predetermined polynomial reflector curve into a number of segments.

Following this, the shape of the predetermined reflector curve is then approximated by linking together a plurality of circular arcs, one for each curve segment, each of which has a radius which approximately matches the shape of a corresponding curve segment. The circular arcs are arranged and connected so that at adjoining end points thereof the slopes of the circular arcs are equal.

The step of constructing the trial metal stamping tool is then preferably performed such that the cross-sectional configuration thereof is comprised of a plurality of linked together circular arcs whose radii are smaller than corresponding ones of the circular arcs for approximating the shape of the predetermined reflector curve. The trial tool circular arcs are also arranged and connected so that at adjoining end points thereof the slopes of the trial tool circular arcs are equal.

Here, the measuring step comprises measuring the trial reflector shape to determine the trial reflector radius produced by a corresponding one of the trial tool circular arcs and then plotting the results in a Cartesian coordinate system with the trial tool circular arc radii along one axis and the measured trial reflector radii along the other axis to obtain the calibration function and then constructing the other metal stamping tool from a plurality of circular arcs whose radii are related respectively by the calibration function to the radii of the circular arcs for approximating the predetermined reflector shape.

Criteria are included for determining the preferred number of curve segments to be used in approximating a polynomial curve.

DESCRIPTION OF THE DRAWINGS

The novel features that are considered characteristic of the invention are set forth with particularity in the appended claims. The preferred mode of practicing the invention, however, will best be understood from the following description of the illustrated method when read in connection with the accompanying drawings wherein like numbers have been employed in the different figures to denote the same parts and wherein:

DESCRIPTION OF THE PREFERRED METHOD

This invention is a method for making a metal stamping die that is suitable for use in forming sheet metal reflectors which have particular utility in lighting apparatus for photographic use. The preferred mode of practicing the method of the invention will be illustrated in connection with its use in fabricating a particular type of reflector having a cross-sectional shape in the form of a polynomial curve which operates to provide smooth distributions of illumination over a predetermined area thereby rendering it particularly suitable for use in photographic lighting applications. However, it is to be expressly understood that the practice of the method of the invention is not in any way restricted to the particular polynomial-shaped reflector illustrated herein and that the method of the invention can be easily adapted for use in making metal stamping dies suitable for use in forming sheet metal reflectors having a variety of cross-sectional shapes which, for example, might include the conic sections as well as other complex curves.

Figure 1:
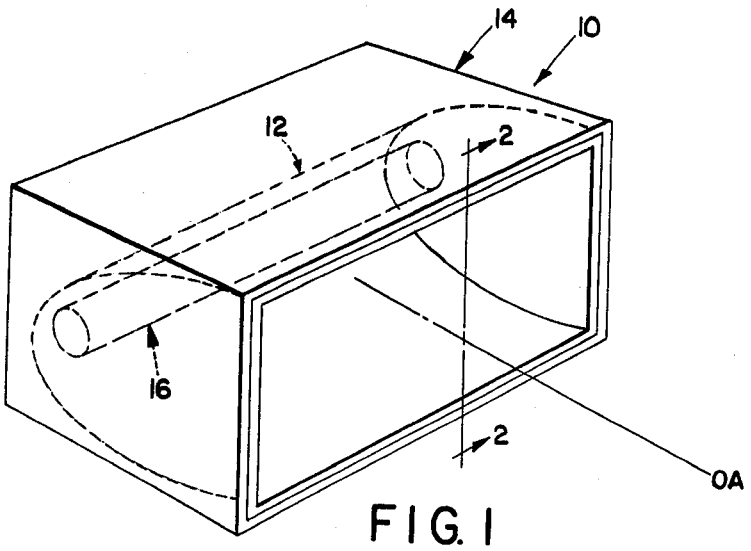
FIG. 1 is a perspective view of an artificial lighting apparatus having incorporated therein a reflector of the type which is particularly suitable for fabrication according to the method of the invention.

Referring now to FIG. 1, there is shown at 10 a lighting apparatus of the type that is used to provide artificial illumination of a photographic scene to supplement natural available illumination so that the overall level of illumination during a photographic exposure is adequate to properly expose a film. The lighting apparatus 10 comprises a housing 14 in which is disposed an elongated cylindrical source of artificial illumination 16 of given length and diameter. The source 16 can, for example, be a conventional electronic strobe tube. Surrounding the source 16 is a concave, open-ended reflector 12 that is bilaterally symmetric about a horizontal plane containing the axis, OA. The reflector 12 is of given width and as a constant cross-sectional shape which was determined in a manner described in more detail in previously-referenced U.S. Pat. application (our Case No. 6364).

Figure 2:
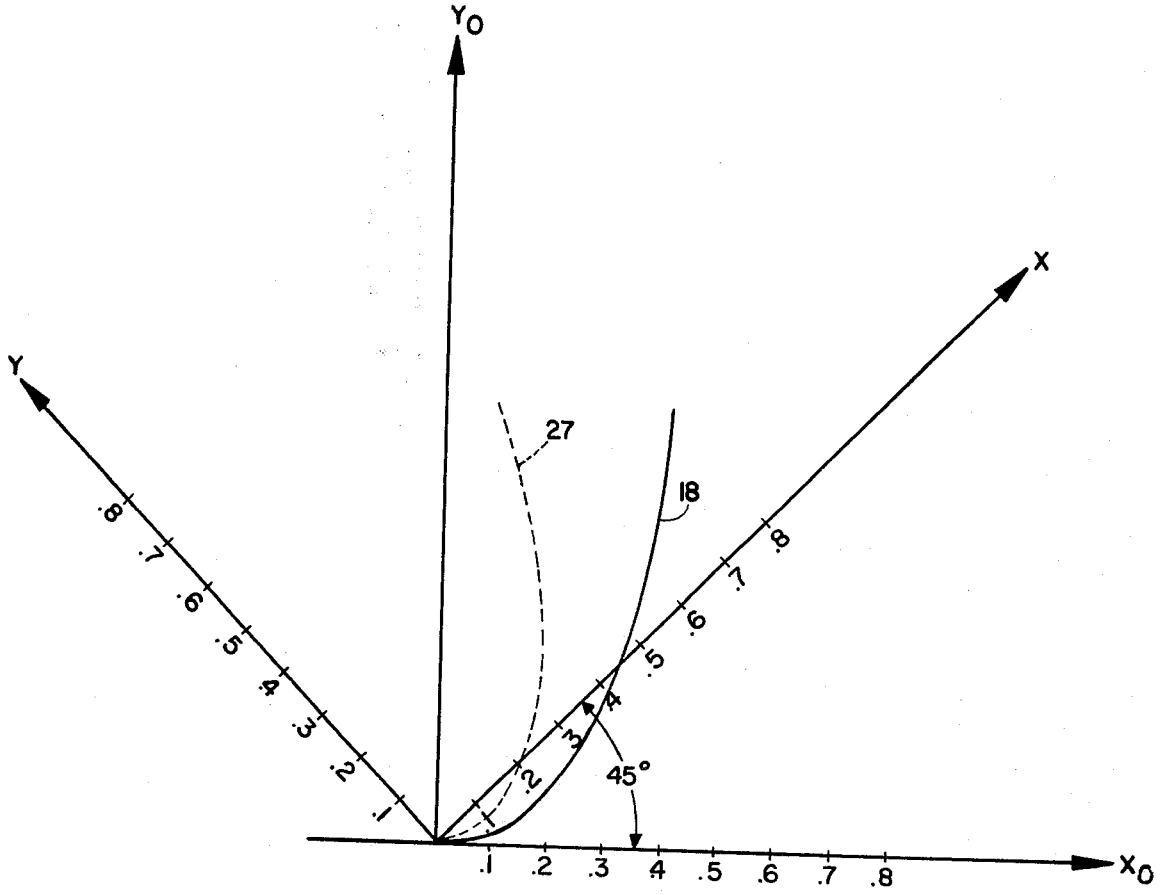
FIG. 2 is a graph giving, in part, the cross-sectional shape of the reflector in FIG. 1 as taken generally along section line 2—2 of FIG. 1.

The cross-sectional shape of the reflector 12 is preferably in the form of a seventh order polynomial curve which is shown at 18 in FIG. 2 and given by the equation:

$$Y = \sum_{n=0}^{7} A_n X^n$$

where Y and X are, respectively, the dependent and independent variables in a Cartesian coordinate system and the terms, $A_n$, represent coefficients of the polynomial. The values of the coefficients, $A_n$, are, for $X \geqq = 0$, as follows:

$A_0 = 0.0$
$A_1 = -1.0473509$
$A_2 = 6.074585$
$A_3 = -20.471872$
$A_4 = 47.502146$
$A_5 = -63.91636$
$A_6 = 45.333022$
$A_7 = -13.07712$ when the Cartesian coordinate system in which the polynomial is given (X–Y) is rotated by 45° with respect to a reference system, $X_0$–$Y_0$, as shown in FIG. 2.

Figure 3:
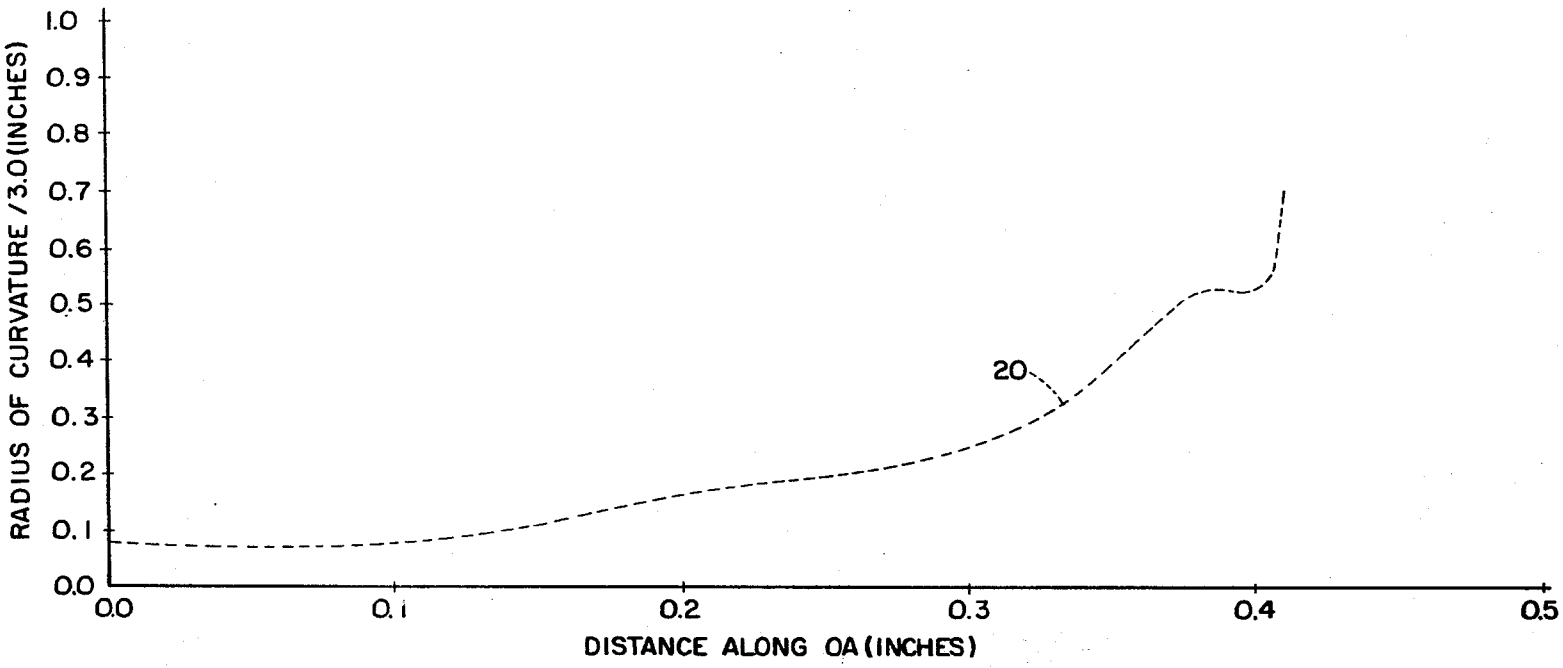
FIG. 3 is a graph showing the local radius of curvature of the solid curve of FIG. 2.

The radius of curvature for the curve 18 representing the shape of the reflector 12 is shown in FIG. 3 as the curve 20. As those skilled in the optical arts will appreciate, the local optical power of the reflector 12, which depends on the local radius of curvature thereof, progressively changes in a gradual manner without discontinuities with distance along the curve 18. The curve 18 is shaped so that the radius of curvature thereof increases with increasing distance from the apex thereof so as to reduce the optical power of the reflector 12 in a predetermined manner with increasing distance along the curve 18. The cross-sectional shape of the reflector 12, when used in combination with the artificial source 16, operates to project a beam of illumination having uniform intensity within a given solid angle. The polynomial shape of the reflector 12 has been selected to provide a reflected, defocused image of the source 16, and the size of the defocused image increases with increasing angular divergence of light rays within the beam to compensate for natural losses in illumination which would otherwise occur as a function of angular divergence of light rays from the source 16 when used without the reflector 12. In this manner, the reflector 12, in combination with the source 16, creates no abrupt changes in illumination. This property is a consequence of the seventh order polynomial shape of the reflector 12 whose first and second derivatives, which determine the local radius of curvature for the curve 18, are continuous in a mathematical sense. Therefore, the local radius of curvature and hence the optical power of the reflector 12 are also continuous thereby operating to provide a smooth distribution of illumination over a predetermined solid angle over which the lighting apparatus 10 operates.

Figure 4:
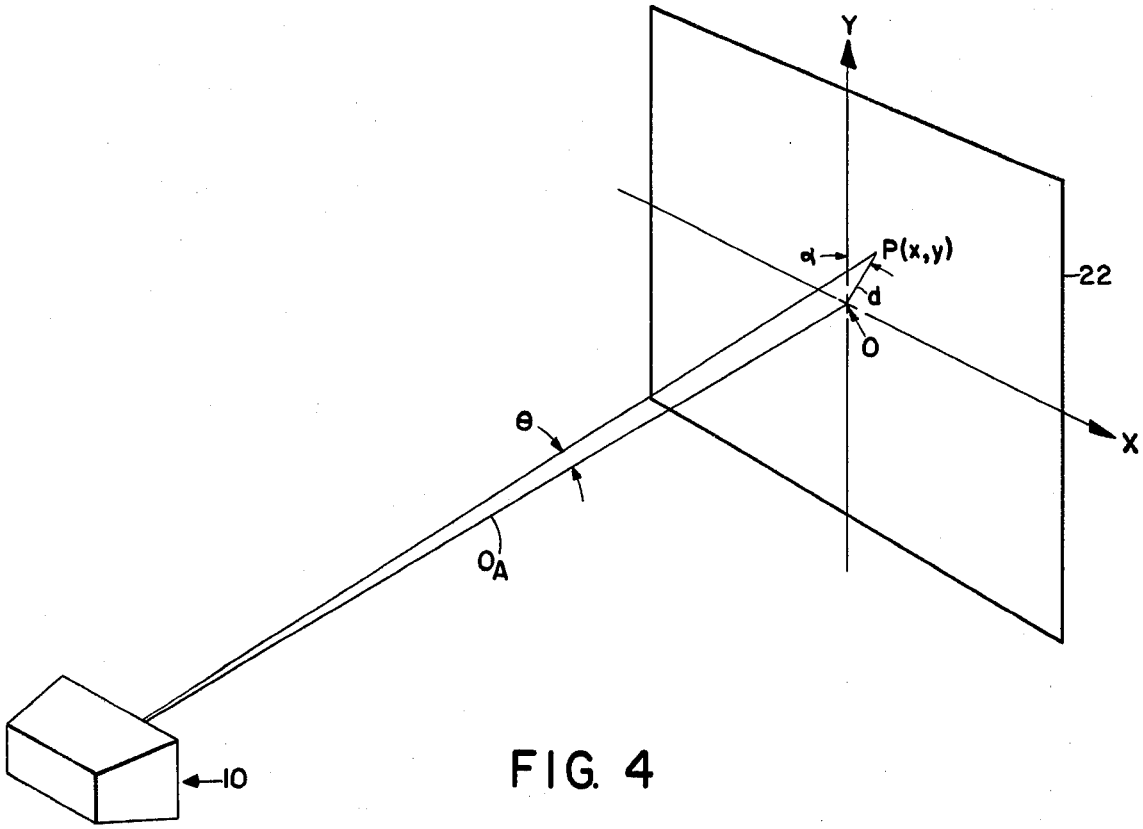
FIG. 4 is a diagrammatic perspective view of the apparatus of FIG. 1 positioned forwardly of a normal plane on which the intensity of illumination provided by the apparatus of FIG. 1 can be measured.

The nature of the illumination distribution provided by the apparatus 10 will best be understood by describing, in conjunction with the diagram of FIG. 4, a technique by which the characteristic distribution of illumination intensity for the apparatus 10 can be measured and characterized. Referring now to FIG. 4, the artificial lighting apparatus 10 is shown positioned forwardly of a plane 22 defined by an orthogonal coordinate system (X–Y axis) whose origin, O, is coincidental with the axis, OA. The plane 22 thus defined is arranged normal to the axis, OA, and is spaced away from the lighting apparatus 10 by a distance which is representative of one of the distances over which the lighting apparatus 10 is expected to be used for purposes of illuminating subjects located ahead of it. For photographic purposes, for example, the distances over which the lighting apparatus 10 might reasonably be expected to be used could be from 3 to 20 feet. Conventionally, the Y-axis on the normal plane 22 corresponds to vertical orientation while the X-axis corresponds to the horizontal.

Once the normal plane 22 is defined photodetectors (not shown) are placed on the normal plane 22 at equally spaced apart points surrounding its origin, O, and covering an area over which the illumination is desired to be measured. The lighting apparatus 10 is then energized, the light flux falling at each point is measured in conventional units such as meter-candles (or meter-candle-seconds in the case of a transient source) and the resultant data tabulated in a form convenient for graphical presentation. For example, the location of a point, P (x, y), can be expressed in terms of its distance, d, from the origin, O, and an angle, $\alpha$, which is the angle between a line drawn from the origin, O, to the point, P, and the Y-axis or by the angle, $\alpha$, and a semi-field angle, $\theta$, which is the angle between the axis, OA, and a line drawn from the center of the open end of the reflector 12 to the point, P. Either convention for describing all points on the normal plane is acceptable.

Figure 5:
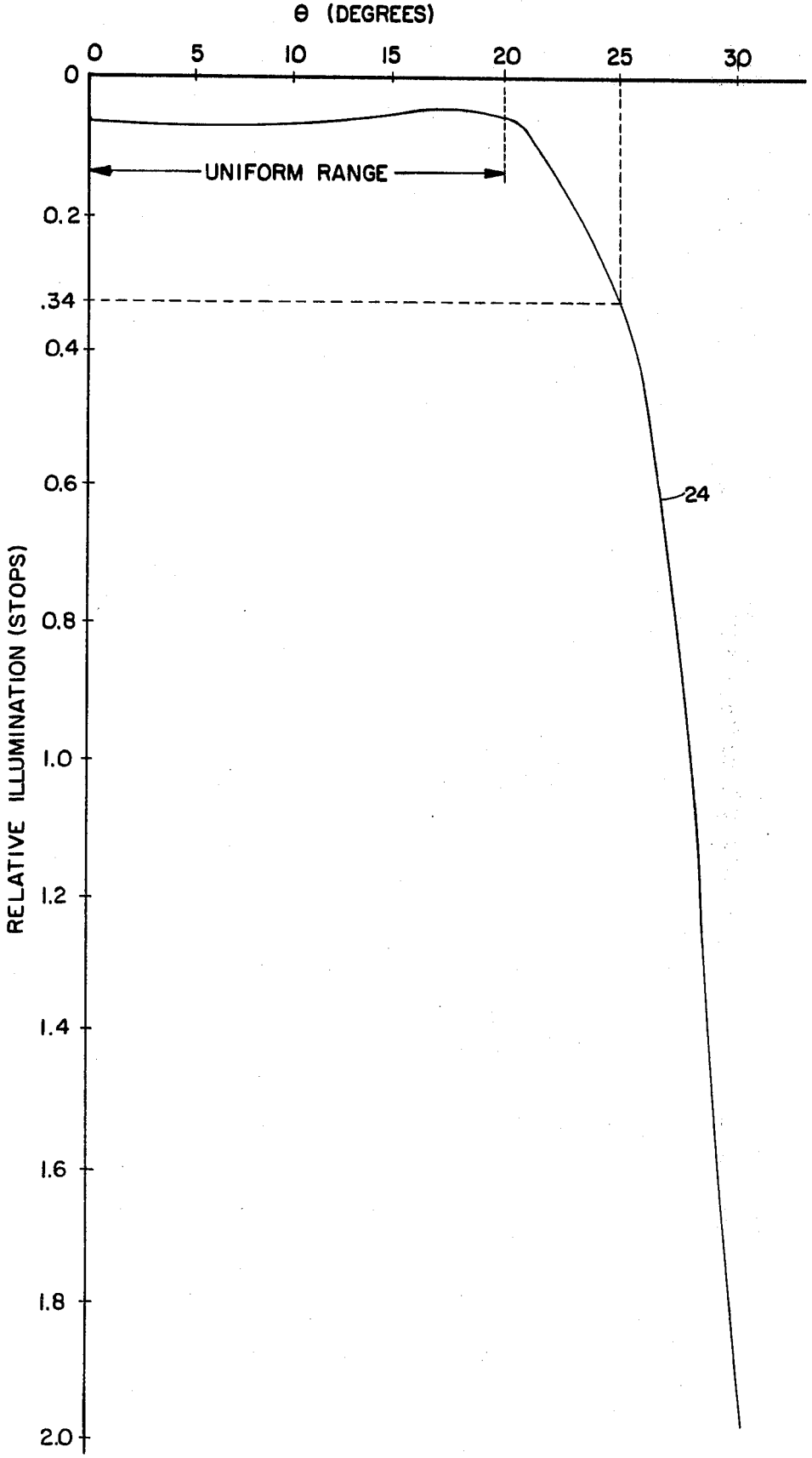
FIG. 5 is a graph showing the intensity of illumination as a function of angular field position for points along a vertical line of the normal plane of FIG. 4.

The distribution and the intensity of the illumination of a beam provided by the apparatus 10 for its foregoing configuration, measured in the foregoing manner on a normal plane spaced approximately 5 feet forward of the lighting apparatus as measured along the Y-axis ($\propto = 0$, $\theta$ varying positively as measured upwards) is presented in FIG. 5 as curve 24. Thus, the curve 24 in FIG. 5 represents the variation in intensity of the illumination over the normal plane as a function of semi-field angle, $\theta$, for points along the Y-axis starting from the origin, O, and ending at a point whose semi-field angle, $\theta$, equals approximately 30°.

The variation in intensity, i.e., the ordinate in FIG. 5, represents the difference in the intensity of illumination, expressed in stops, for different points along the Y-axis as compared to the peak intensity of illumination measured at some point on the normal plane 22. Thus, for example, the illumination of a point on the Y-axis whose position is specified by the semi-field angle, $\theta = 25°$, is approximately −0.34 stops lower in intensity than the peak intensity recorded on the normal plane 22. The calculations for arriving at the relative illumination expressed in stops were made in accordance with the following equation:

$$\text{Relative Illumination (stops)} = \log_2 \frac{\text{(measured intensity)}}{\text{(measured peak intensity)}}$$

As will be appreciated from FIG. 5, the lighting apparatus 10 illuminates a line corresponding to the vertical or Y-axis over a predetermined angle which corresponds approximately to a semi-field angle of 30° and, within that angle of divergence, it can be seen that there is another angle which is approximately at 20° over which the intensity of the illumination along the vertical axis is substantially uniform exhibiting very slight variation from $\theta = 0°$ to $\theta = 20°$.

The cross-sectional shape of the reflector 12 operates to control the distribution in the intensity of the illumination of the beam provided by the apparatus 10 along vertical lines in the normal plane which, in FIG. 4, are lines parallel to the Y-axis. The intensity of the illumination along lines parallel to the X-axis in FIG. 4 change as though the reflector 12 were not present and instead were illuminated by the elongated flash tube 16 having a plane mirror located behind it. Thus, the intensity of the illumination provided by the apparatus 10 is only substantially constant along the Y-axis of FIG. 4 and over a semi-field angle of approximately 20°. The intensity of the illumination along other vertical lines, parallel to the Y-axis in FIG. 4, is diminished in amplitude the further such lines are spaced away from the Y-axis and further modified because of the plane mirror effect previously discussed. However, even though diminished overall in amplitude, the intensity over other vertical lines would also vary in a uniform manner without exhibiting any abrupt changes and would be substantially similar to the curve 24 illustrated in FIG. 5.

The lighting performance of the polynomial-shaped reflector 12 obviously depends on how well its polynomial shape can be produced with a particular manufacturing process. If the polynomial shape of the reflector 12 is perfectly reproduced, its lighting performance will be exactly as described above. If the reflector 12 were fabricated using optical injection molding and coating techniques for fabricating plastic lenses, rather exact conformance with its shape could be achieved but at considerable expense. However, according to the teachings of the present invention, reflectors of this polynomial sort, as well as others, can be formed by metal stamping to a sufficient approximation of the polynomial shape so that the reflectors formed thereby perform in apparently the same manner as the precise polynomial shape. The method of the invention by which such performance can be achieved through the use of metal stamping may now be best understood by referring to FIG. 6 wherein there is shown at 18 the cross-sectional shape of the reflector 12.

The initial steps of the method involve first approximating the polynomial-shaped reflector curve 18 by linking together a plurality of circular arcs which approximately match the shape of the curve 18. This is accomplished by first dividing the curve 18 into a number of segments such as those indicated by way of illustration at S1–S4 in FIG. 6. The rationale for the circular arc approximation is two-fold. First, it is traditional in the metal stamping art to approximate complex curve shapes by circular arcs and it is convenient to make such an approximation because many automatic machine cutting tools are internally programmed to accept curve definitions in terms of circular arcs and their centers of rotation. The second reason is that the polynomial shape does not need to be precisely replicated by a metal stamping tool if any departures from the exact polynomial shape are small enough so that the attendant abrupt changes in the illumination caused thereby cannot be visually detected in a photograph as a density change. Apparently, abrupt changes in illumination of 0.2 stops are detectable visually and therefore this would set a limit on how continuous a stamped reflector shape and hence its second derivative would need to be. However, the 0.2 stop limit will obviously vary from film to film and will depend on the sensitometric characteristics of the particular film with which the lighting apparatus 10 is to be used.

The total number of segments into which the reflector curve 18 is divided is preferably determined by first calculating the ratio of the maximum radius of curvature to the minimum radius of curvature for the predetermined reflector shape as given by the following equation:

$$S = \log_2 \frac{R_{max}}{R_{min}}$$

where S is in stops and $R_{max}$ and $R_{min}$ are respectively the maximum and minimum radii of curvature of the predetermined reflector curve. The number of segments is then obtained by dividing S by no more than 0.5 to arrive at the number of curve segments but it is recommended that S be divided by no more than 0.2 for optimum results. The rationale behind the equation for determining the number of curve segments is based on the following. The local reflector power depends on the local radius of curvature and changes from a maximum value to a minimum value in correspondence with the change in radius of curvature. This change expressed as a ratio calculated in stops represents the corresponding change in the intensity of illumination effected by the reflector if it is assumed that illumination intensity is linearly proportional to optical power. It has been found that the optical power change of the reflector, if distributed among the segments in increments equal or proportional to the illumination change corresponding to density changes which can be visually detected, results in an approximation to the exact polynomial curve whose illumination performance is apparently, i.e. visually, as good as that of the exact polynomial since any abrupt changes in illumination caused thereby cannot be seen in pictures.

The next step after dividing the predetermined reflector curve into a number of segments is to approximate the shape of the reflector curve 18 by linking together a plurality of circular arcs, one for each curve segment S1–S4. It is required that each circular arc have a radius which approximately matches the shape of a corresponding curve segment. Thus, in FIG. 6 R1, having a center at C1, has the approximate shape of the curve segment S1; R2, having a center at C2, has the approximate shape for the curve segment S2; R3, having a center at C3, has the approximate shape for the curve segment S3; and R4, having a center at C4, has the approximate shape for the curve segment S4. It will be noticed in FIG. 6 that the centers of adjacent circular arcs are located along the same line so that the circular arcs which approximate the polynomial reflector curve shape are arranged and connected in such a way that at their adjoining end points the slopes of the adjacent circular arcs are equal.

After having determined the circular arc approximation to the desired polynomial reflector curve shape, a trial metal stamping tool is then constructed having a cross-sectional configuration of the same general shape as that of the reflector polynomial curve 18 but being of greater concavity. Such a trial tool shape, for example, might be like that designated at 27 in FIG. 2.

The purpose of shaping the trial tool in this manner is to be able to form a trial reflector shape which can be measured and related to the trial tool shape in such a way that a final tool shape can be determined which accounts for the inherent spring-back characteristics of the material from which the reflector 12 is formed.

Thus, a trial tool is constructed having a cross-sectional configuration of greater concavity than that of the reflector polynomial curve 18 and comprising a plurality of linked-together circular arcs whose radii are smaller than corresponding ones of the circular arcs for approximating the shape of the predetermined reflector curve (R1–R4). The trial tool circular arcs are also preferably arranged and connected so that at adjoining end points thereof the slopes of the trial tool circular arcs are equal.

Figure 7:
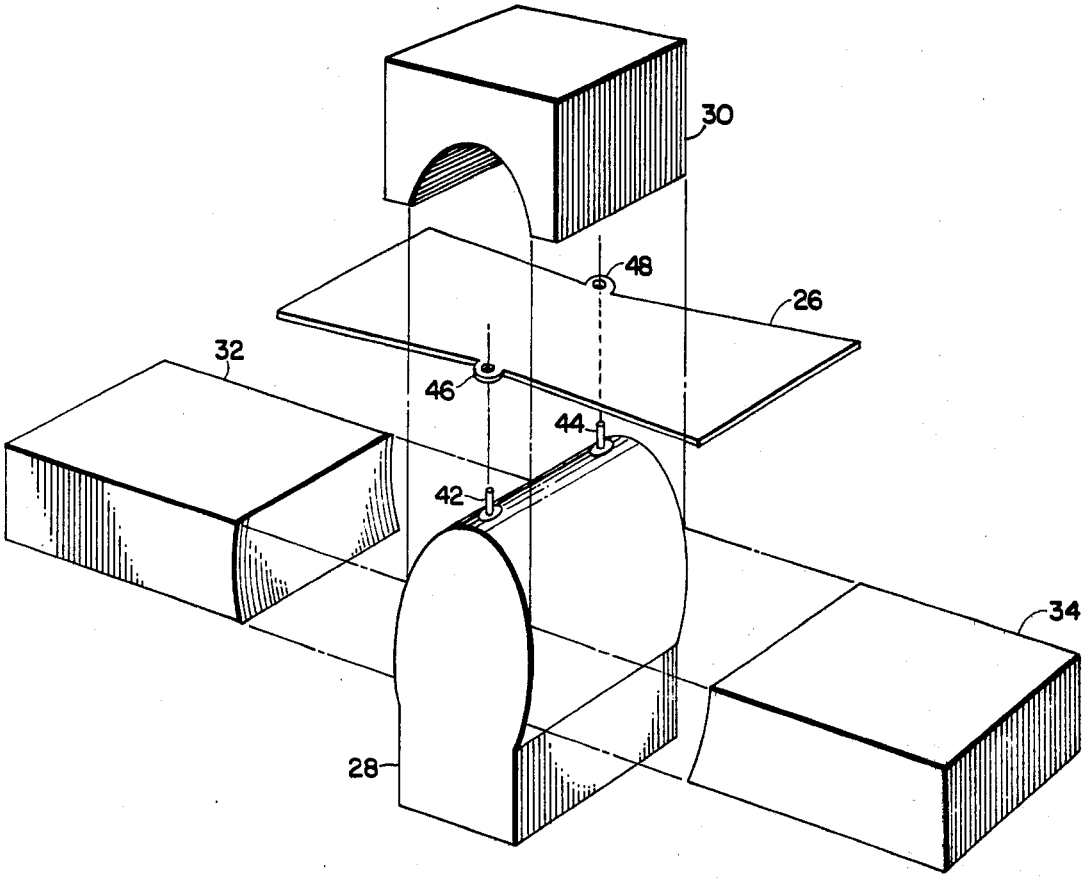
FIG. 7 is a perspective view diagrammatically showing various parts of a metal stamping die and a metal blank used in practicing the method of the invention.

The configuration for the trial tool is preferably similar to the metal stamping tool illustrated in FIG. 7 which comprises a mandrel section 28 whose cross-sectional shape has been determined in the manner described, a hammer section 30 whose cross-sectional shape is complementary to that of the upper portion of the mandrel section 28 but has been adjusted for the thickness of a metal blank 26 which is to be formed by the tool, and two side stamping sections, 32 and 34, whose shapes, adjusted for material thickness, correspond to the lower portions of the mandrel 28. The tool is preferably shaped by an automatically controlled electric discharge cutting machine and has its surfaces polished after cutting for optical reasons. A pair of locating pins, 42 and 44, are provided to extend upwardly from the top of the mandrel 28 to enter a pair of registration holes, 46 and 48 respectively, which are located in the metal blank 26 to aid in locating it.

In operation, the hammer section 30 first forms the metal blank 26 around the upper portion of the mandrel 28 and thereafter the side sections, 32 and 34, move toward corresponding side portions of the mandrel 28 to complete the formation of a trial reflector. When the hammer 30 and the two side sections, 32 and 34, of the metal stamping tool are moved away from the mandrel 28, the trial reflector 26 springs back to assume its natural shape after the stamping operation.

Figure 8:
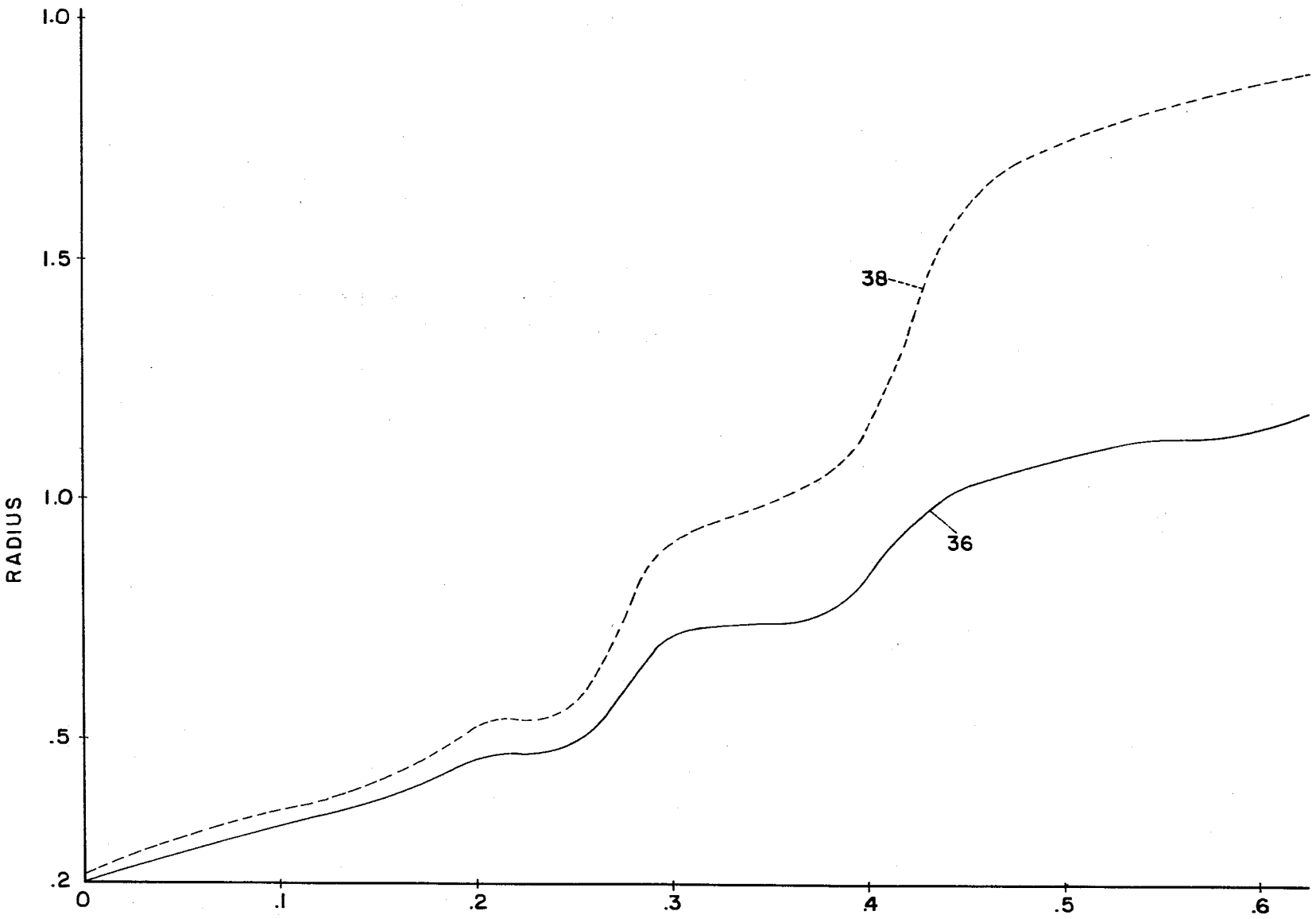
FIG. 8 is a graph diagrammatically showing a comparison between the cross-sectional configuration of the die illustrated in FIG. 7 and a trial metal workpiece constructed with the die.

After the trial reflector 26 is formed with the trial tool, the shape of the trial reflector 26 is then measured by measuring discrete points along its surface and then calculating its radii and plotting the resultant radii as a function of distance along the axis OA as illustrated by the curve 38 in FIG. 8. Plotted on the same graph in FIG. 8 is a curve 36 which represents the radii of the trial tool as a function of distance along the optical axis, OA. The trial tool radii are determined by the same method which is used to arrive at the trial reflector radii. Thus the two curves, 36 and 38, graphically portray the trial reflector radii which are reproduced by corresponding radii of the trial tool. The curves, 36 and 38, it will be noted are not exact step functions as one might expect because, for example, of tool polishing, and the mathematical technique used in calculating the tool and trial reflector radii from discrete measurements. The difference between the two curves, 36 and 38, is a measure of the spring-back characteristics of the trial reflector.

Figure 9:
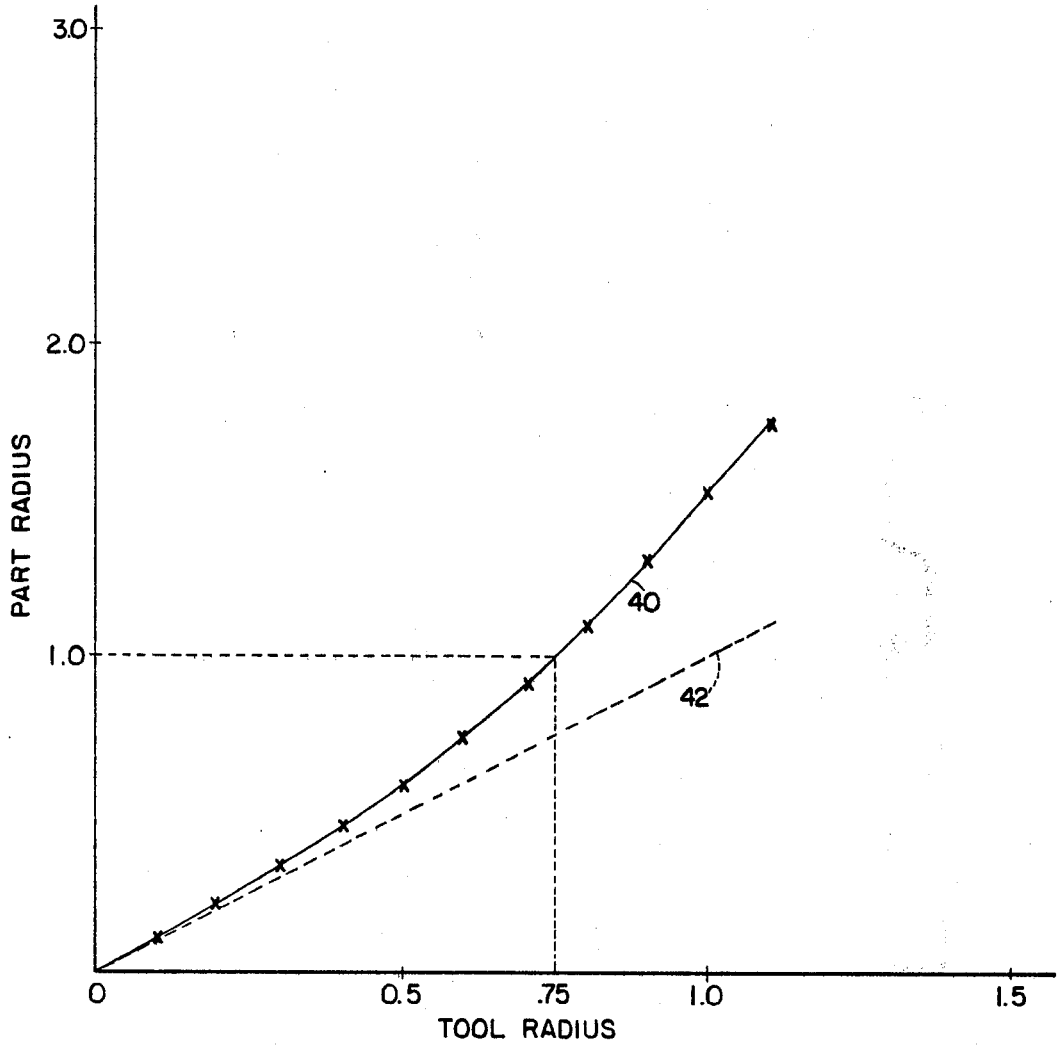
FIG. 9 is a graph diagrammatically showing a relationship between the cross-sectional configuration of the die of FIG. 8 and a workpiece formed with it.

Once the spring-back characteristics of the trial reflector have been established as indicated by the data plotted in FIG. 8, a calibration function can be plotted which relates the tool radius required to produce a corresponding reflector radius as shown by the curve 40 in FIG. 9. The curve 40 of FIG. 9 thus represents, for the particular stamping conditions utilized in forming the trial tool, what tool shape will replicate a corresponding reflector shape. The straight line 42 in FIG. 9 indicates, for comparison, the difference between a reflector having no spring-back characteristics, i.e., the tool exactly reproduces the desired reflector shape, while the calibration function 40 clearly indicates that the tool radius required to produce a desired reflector radius is, in general, different.

Figure 6:
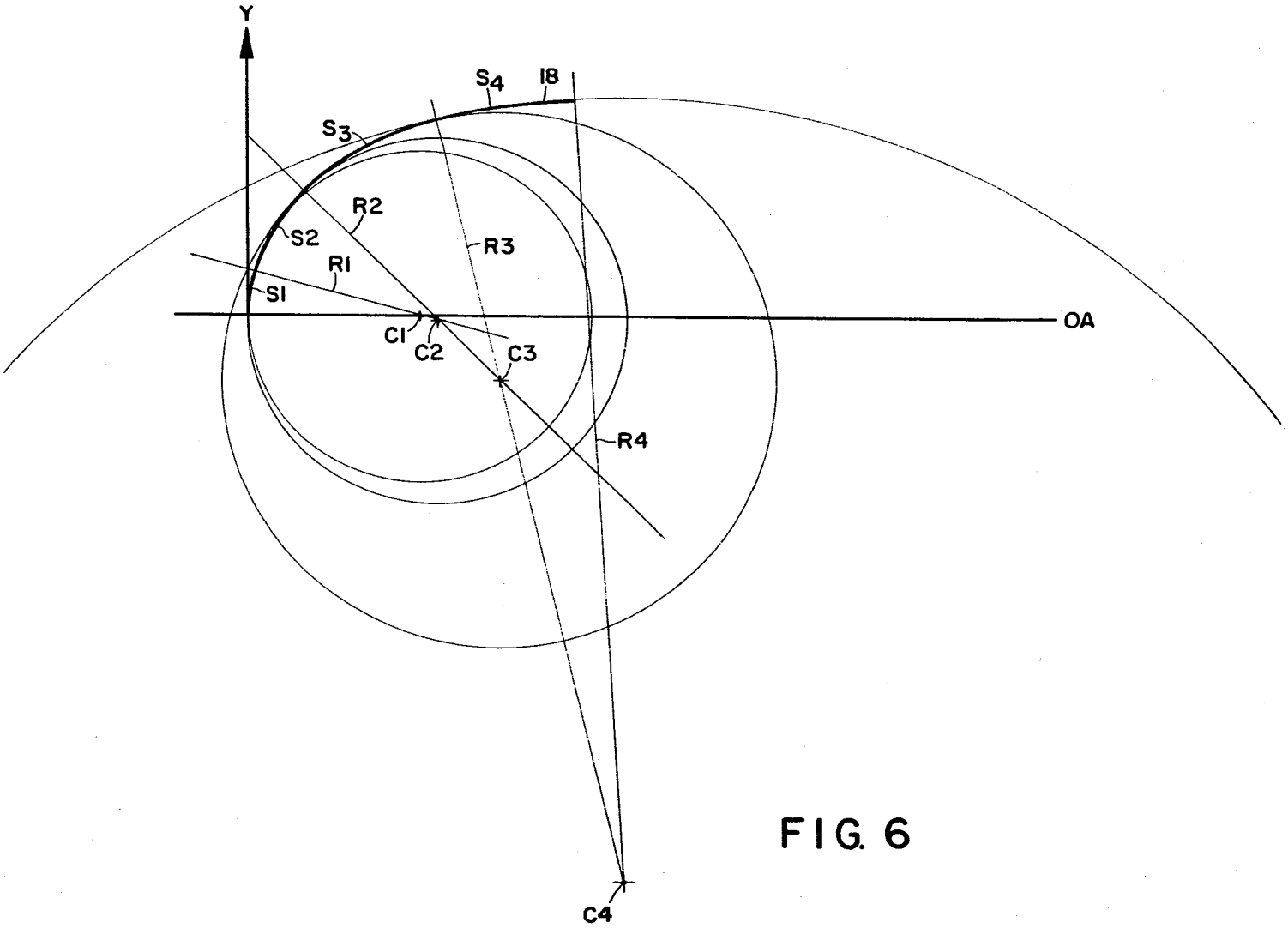
FIG. 6 is a diagrammatic view illustrating how an approximation to the solid curve of FIG. 2 is constructed.

Having established the relationship between the tool shape required to produce a corresponding reflector shape, the next step in the process is to construct another metal stamping tool having a cross-sectional configuration which is shaped in accordance with the calibration function 40 to obtain a final die shape that will acceptably produce the approximation to the desired predetermined reflector polynomial shape as given by the curve 18 in FIG. 6. To construct the final metal stamping tool, the tool radius which is required to produce a corresponding circular arc approximation radius to the polynomial curve of the reflector 12 is determined by simply choosing the proper value of the circular arc approximation radius from the ordinate of the calibration function 40 in FIG. 9 and finding the corresponding tool radius required to reproduce that radius. For example, if it is desired to have a reflector radius of 1" for a particular portion of the reflector approximation, then the required tool radius to reproduce a reflector radius of 1" would be 0.75" as shown in FIG. 9. If further refinements are required in shaping the reflector, further calibration functions can be generated until a final die shape is established which will acceptably reproduce the desired reflector shape.

Certain changes may be made in the above-described method without departing from the scope of the invention. For example, instead of the circular arc approximation to the polynomial shape, it is possible to develop a trial tool having a shape which is of the same general shape as that of the reflector predetermined curve and having a radius of curvature which continuously changes but which is generally smaller than the radius of curvature of correponding portions of the reflector curve. A trial reflector can be made with such a trial tool and the method can be practiced as before to determine an appropriate calibration function. However, a metal stamping tool having continuous radii of curvature changes would obviously be more expensive than the approximation of the preferred embodiment. In addition, it would be possible to utilize a series of linked together third order polynomial splines to approximate the shape of the curve segments referenced hereinabove instead of the circular arc approximations.

Those skilled in the art may make still other changes according to the teachings of the disclosure. Therefore, it is intended that all subject matter contained in the above description or shown in the accompanying drawings shall be interpreted as illustrative and not in a limiting sense.

What is claimed is:

1. A method for making a metal stamping tool suitable for use in forming a concave, open ended reflector having a cross-sectional shape in the form of a nonconic, asphere that is bilaterally symmetric about a central axis therethrough and has a radius of curvature that continuously increases with distance along said axis comprising the steps of:

constructing a trial metal stamping tool having a cross-sectional shape in the form of nonconic, asphere that is more concave than the reflector, said trial tool curve being of the same general shape as said reflector but having a continuously changing radius of curvature that is generally smaller than that of the reflector at corresponding points along the reflector axis of symmetry;

forming a trial reflector by stamping with said trial tool a metal blank workpiece of predetermined thickness and material composition; and constructing a final metal stamping tool having a cross-sectional shape whose radius of curvature varies continuously along the reflector axis of symmetry in accordance with the ratio between said radius of curvature of said trial tool and said trial reflector at corresponding points along the reflector axis of symmetry.

2. The method of claim 1 wherein said radius of curvature of said final metal stamping tool has centers of curvature which are identical with those of the reflector.

3. A method for making a metal stamping tool suitable for use in forming a concave, open-ended reflector having a cross-sectional shape in the form of a non-conic, asphere that is bilaterally symmetric about a central axis therethrough and has a radius of curvature that continuously increases with distance along said axis comprising the steps of:

constructing a trial metal stamping tool having a cross-sectional shape in the form of plurality of linked together circular arcs, one each for a corresponding curve segment of the reflector curve and each having a radius which approximately matches the shape of a corresponding curve segment of the reflector, said circular arcs being arranged and connected so that at adjoining end points thereof the slopes of said circular arcs are equal, said trial tool shape being of the same general shape as, but being more concave than, the shape of the reflector at corresponding points along the reflector axis of symmetry;

forming a trial reflector by stamping with said trial tool a metal blank workpiece of predetermined thickness and material composition; and constructing a final metal stamping tool having a cross-sectional shape in the form of a plurality of linked together circular arcs, one each for a corresponding segment of the reflector curve, and each having a radius which depends on the ratio of radii between corresponding segments of said trial tool and said trial reflector at corresponding points along the reflector axis of symmetry.

4. The method of claim 12 wherein the number of circular arcs is given by:

$$S = \frac{1}{K} \cdot \log_2 \frac{R\text{-max}}{R\text{-min}}$$

wherein S is the number of curve segments, K is a constant no greater than 0.5, and R-max and R-min are respectively the maximum and minimum radii of curvature of the curve.

5. The method of claim 4 wherein adjoining end points of said circular arcs have centers lying on the same line.

6. The method of claim 4 wherein K is no more than 0.2.

* * * * *